US010006108B2

(12) United States Patent
Wen et al.

(10) Patent No.: US 10,006,108 B2
(45) Date of Patent: Jun. 26, 2018

(54) ALUMINUM ALLOYS FOR HIGHLY SHAPED PACKAGING PRODUCTS AND METHODS OF MAKING THE SAME

(71) Applicant: NOVELIS INC., Atlanta, GA (US)

(72) Inventors: Wei Wen, Powder Springs, GA (US); Johnson Go, Marietta, GA (US); Daehoon Kang, Kennesaw, GA (US)

(73) Assignee: NOVELIS INC., Atlanta, GA (US)

( * ) Notice: Subject to any disclaimer, the term of this patent is extended or adjusted under 35 U.S.C. 154(b) by 173 days.

(21) Appl. No.: 15/067,276

(22) Filed: Mar. 11, 2016

(65) Prior Publication Data

US 2016/0265090 A1 Sep. 15, 2016

Related U.S. Application Data

(60) Provisional application No. 62/132,534, filed on Mar. 13, 2015.

(51) Int. Cl.

| | |
|---|---|
| ***C22C 21/18*** | (2006.01) |
| ***C22C 21/00*** | (2006.01) |
| ***C22C 21/06*** | (2006.01) |
| ***C22C 21/08*** | (2006.01) |
| ***C22C 21/12*** | (2006.01) |
| ***C22C 21/14*** | (2006.01) |
| ***C22C 21/16*** | (2006.01) |
| ***C22F 1/04*** | (2006.01) |

(Continued)

(52) U.S. Cl.

CPC ..... *C22C 21/18* (2013.01); *C21D 1/26* (2013.01); *C21D 8/0226* (2013.01); *C21D 8/0236* (2013.01); *C21D 8/0263* (2013.01); *C21D 9/46* (2013.01); *C22C 21/00* (2013.01); *C22C 21/06* (2013.01); *C22C 21/08* (2013.01); *C22C 21/12* (2013.01); *C22C 21/14* (2013.01); *C22C 21/16* (2013.01); *C22F 1/04* (2013.01); *C22F 1/047* (2013.01); *C22F 1/057* (2013.01)

(58) Field of Classification Search

CPC ..... C22C 21/18; C22C 21/16; C22C 21/14; C22C 21/00; C22C 21/06; C22C 21/08; C22C 21/12; C22F 1/04; C22F 1/047; C22F 1/057; C21D 9/46

USPC ..... 420/532

See application file for complete search history.

(56) References Cited

U.S. PATENT DOCUMENTS

| | | | |
|---|---|---|---|
| 5,634,991 | A | 6/1997 | Kamat |
| 2002/0043311 | A1 | 4/2002 | Selepack et al. |

(Continued)

FOREIGN PATENT DOCUMENTS

| | | | |
|---|---|---|---|
| EP | 0039211 | B1 | 1/1985 |
| EP | 1870481 | A1 | 12/2007 |

(Continued)

OTHER PUBLICATIONS

Inaba et al., "Bake-Hardening Behavior of Aluminum Alloy 3004 and High Strength Can Body Stock," Aluminum Alloys for Packaging, 1993, pp. 227-235, The Minerals, Metals & materials Society, US.

(Continued)

*Primary Examiner* — Helene Klemanski

(74) *Attorney, Agent, or Firm* — Kilpatrick Townsend & Stockton LLP

(57) ABSTRACT

The disclosure is related to new, formable and strong aluminum alloys for making packaging products such as bottles and cans.

10 Claims, 4 Drawing Sheets

(51) Int. Cl.

| | |
|---|---|
| ***C22F 1/047*** | (2006.01) |
| ***C22F 1/057*** | (2006.01) |
| ***C21D 9/46*** | (2006.01) |
| ***C21D 8/02*** | (2006.01) |
| ***C21D 1/26*** | (2006.01) |

(56) References Cited

U.S. PATENT DOCUMENTS

| | | | |
|---|---|---|---|
| 2006/0240270 | A1 | 10/2006 | Kuroda et al. |
| 2009/0053099 | A1 | 2/2009 | Kajihara et al. |
| 2012/0227870 | A1 | 9/2012 | Inoue et al. |
| 2012/0227871 | A1 | 9/2012 | Inoue et al. |
| 2016/0076126 | A1 | 3/2016 | Go et al. |

FOREIGN PATENT DOCUMENTS

| | | | | |
|---|---|---|---|---|
| JP | 2012172192 | A | * | 9/2012 |
| WO | 2005110640 | A1 | | 11/2005 |
| WO | 2013188668 | A2 | | 12/2013 |

OTHER PUBLICATIONS

Zhu et al., "Solution strengthening and age hardening capability of Al—Mg—Mn alloys with small additions of Cu," Materials Science and Engineering A, 2008, pp. 125-133, vol. 488, Elsevier BV.

International Patent Application No. PCT/US2016/021914, International Search Report and Written Opinion dated May 24, 2016, 10 pages.

International Patent Application No. PCT/US2016/021914, International Preliminary Report on Patentability dated Sep. 28, 2017, 7 pages.

* cited by examiner

ALUMINUM ALLOYS FOR HIGHLY SHAPED PACKAGING PRODUCTS AND METHODS OF MAKING THE SAME

CROSS-REFERENCE TO RELATED APPLICATION

This application claims the benefit of U.S. Provisional Patent Application No. 62/132,534, filed Mar. 13, 2015, which is incorporated by reference herein in its entirety.

FIELD OF THE INVENTION

The invention provides new aluminum alloys for making packaging products, including bottles, and methods of making these alloys.

BACKGROUND

There are several requirements for alloys used in forming aluminum bottles, i.e. alloy formability, bottle strength, earing and alloy cost. Current alloys for forming bottles are unable to meet all these requirements. Some alloys have high formability but low strength; other alloys that are sufficiently strong have poor formability. Furthermore, current bottle alloys use a large portion of prime aluminum in casting, making their production expensive and unsustainable.

Highly formable alloys for use in manufacturing highly shaped cans and bottles are desired. For shaped bottles, the manufacturing process typically involves first producing a cylinder using a drawing and wall ironing (D&I) process. The resulting cylinder is then formed into a bottle shape using, for example, a sequence of full-body necking steps or other mechanical shaping, or a combination of these processes. The demands on any alloy used in such a process or combination of processes are complex. Thus, there is a need for alloys capable of sustaining high levels of deformation during mechanical shaping for the bottle shaping process and that function well in the D&I process used to make the starting cylindrical preform. In addition, methods are needed for making preforms from the alloy at high speeds and levels of runnability, such as that demonstrated by the current can body alloy AA3104. AA3104 contains a high volume fraction of coarse intermetallic particles formed during casting and modified during homogenization and rolling. These particles play a major role in die cleaning during the D&I process, helping to remove any aluminum or aluminum oxide build-up on the dies, which improves both the metal surface appearance and also the runnability of the sheet.

The other requirements of the alloy are that it must be possible to produce a bottle which meets the targets for mechanical performance (e.g., column strength, rigidity, and a minimum bottom dome reversal pressure in the final shaped product) with lower weight than the current generation of aluminum bottles. The only way to achieve lower weight without significant modification of the design is to reduce the wall thickness of the bottle. This makes meeting the mechanical performance requirement even more challenging.

Another requirement is the ability to form the bottles at a high speed. In order to achieve a high throughput (e.g., 1000 bottles per minute) in commercial production, the shaping of the bottle must be completed in a very short time. Also desired is a bottle incorporating recycled aluminum metal scrap.

SUMMARY

The present invention is related to a new aluminum alloy system for the aluminum bottle application. Both the chemistry and manufacturing processes of the alloy have been optimized for the high speed production of aluminum bottles.

The present invention solves these problems and provides alloys with desired strength, formability and a high content of recycled aluminum metal scrap. The higher content of recycled metal decreases content of prime aluminum and production cost. These alloys are used to make packaging products such as bottles and cans that have relatively high deformation requirements, relatively complicated shapes, variable strength requirements and high recycled content. In various embodiments, the alloys comprise a recycled content of at least 60 wt. %, 65 wt. %, 70 wt. %, 75 wt. %, 80 wt. %, 82 wt. %, 85 wt. %, 90 wt. %, or 95 wt. %.

Although alloys described herein are heat treatable, the precipitation hardening is achieved concurrently with coat/paint curing, thus having minimal or no impact on currently existing bottle forming lines. Because alloys described herein can be produced with a high content of recycled aluminum scraps, the production process is very economic and sustainable.

Alloys

In one embodiment, the chemical composition of the alloy comprises 0.1-1.6 wt. % Mn, 0.1-3 wt. % Mg, 0.1-1.5 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al. In this application, all percentages are expressed in weight percent (wt. %).

In one embodiment, the chemical composition of the alloy comprises 0.1-1.6 wt. % Mn, 0.5-3 wt. % Mg, 0.1-1.5 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

In another embodiment, the chemical composition of the alloy comprises 0.8-1.5 wt. % Mn, 0.6-1.3 wt. % Mg, 0.4-1.0 wt. % Cu, 0.3-0.6 wt. % Fe, 0.15-0.5 wt. % Si, 0.001-0.2 wt. % Cr, 0-0.5 wt. % Zn, 0-0.1 wt. % Ti, <0.05 wt. % for each trace element, <0.15 wt. % for total trace elements and remainder Al.

In yet another embodiment, the chemical composition of the alloy comprises 0.9-1.4 wt. % Mn, 0.65-1.2 wt. % Mg, 0.45-0.9 wt. % Cu, 0.35-0.55 wt. % Fe, 0.2-0.45 wt. % Si, 0.001-0.2 wt. % Cr, 0-0.5 wt. % Zn, 0-0.1 wt. % Ti, <0.05 wt. % for each trace element, <0.15 wt. % for total trace elements and remainder Al.

In another embodiment, the chemical composition of the alloy comprises 0.95-1.3 wt. % Mn, 0.7-1.1 wt. % Mg, 0.5-0.8 wt. % Cu, 0.4-0.5 wt. % Fe, 0.25-0.4 wt. % Si, 0.001-0.2 wt. % Cr, 0-0.5 wt. % Zn, 0-0.1 wt. % Ti, <0.05 wt. % for each trace element, <0.15 wt. % for total trace elements and remainder Al.

In one embodiment, the chemical composition of the alloy comprises 0.1-1.6 wt. % Mn, 0.1-1.0 wt. % Mg, 0.1-1 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

In another embodiment, the chemical composition of the alloy comprises 0.8-1.5 wt. % Mn, 0.2-0.9 wt. % Mg, 0.3-0.8 wt. % Cu, 0.3-0.6 wt. % Fe, 0.15-0.5 wt. % Si, 0.001-0.2 wt.

% Cr, 0-0.5 wt. % Zn, 0-0.1 wt. % Ti, <0.05 wt. % for each trace element, <0.15 wt. % for total trace elements and remainder Al.

In yet another embodiment, the chemical composition of the alloy comprises 0.9-1.4 wt. % Mn, 0.25-0.85 wt. % Mg, 0.35-0.75 wt. % Cu, 0.35-0.55 wt. % Fe, 0.2-0.45 wt. % Si, 0.001-0.2 wt. % Cr, 0-0.5 wt. % Zn, 0-0.1 wt. % Ti, <0.05 wt. % for each trace element, <0.15 wt. % for total trace elements and remainder Al.

In another embodiment, the chemical composition of the alloy comprises 0.95-1.3 wt. % Mn, 0.3-0.8 wt. % Mg, 0.4-0.7 wt. % Cu, 0.4-0.5 wt. % Fe, 0.25-0.4 wt. % Si, 0.001-0.2 wt. % Cr, 0-0.5 wt. % Zn, 0-0.1 wt. % Ti, <0.05 wt. % for each trace element, <0.15 wt. % for total trace elements and remainder Al.

In yet another embodiment, the chemical composition of the alloy comprises 0.1-1.6 wt. % Mn, 0.1-1.5 wt. % Mg, 0.1-1.5 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

In yet another embodiment, the chemical composition of the alloy comprises 0.1-1.6 wt. % Mn, 0.1-1.0 wt. % Mg, 0.1-1.0 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

In another embodiment, the chemical composition of the alloy comprises 0.1-1.6 wt. % Mn, 0.1-0.8 wt. % Mg, 0.1-0.8 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

In another embodiment, the chemical composition of the alloy comprises 0.1-1.6 wt. % Mn, 0.1-0.6 wt. % Mg, 0.1-0.6 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

Method of Producing the Alloys

In one embodiment, the alloys are produced with a thermomechanical process including direct chill (DC) casting, homogenization, hot rolling, optional batch annealing, and cold rolling.

In the DC casting step, a certain casting speed is applied to control the formation of primary intermetallic particles in terms of size and density. The preferred range of casting speed is from 50-300 mm/min This step yields an optimum particle structure in the final sheet that minimizes the tendency of metal failure facilitated by coarse intermetallic particles.

In the homogenization step, the ingot is heated (preferably at a rate of about 20° C. to about 80° C./hour) to less than about 630° C. (preferably to within a range of about 500° C. to about 630° C.) and soaked for 1-6 hours, optionally including the step of being cooling down to within a range of about 400° C. to about 550° C. and soaked for 8-18 hours.

In the hot rolling step, the homogenized ingot is laid down within a temperature range of about 400° C. to about 580° C., break-down rolled, hot rolled to a gauge range of about 1.5 mm to about 3 mm and coiled within a temperature range of about 250° C. to about 380° C. for self-annealing.

In the optional batch annealing, the hot band (HB) coil is heated to within a range of about 250° C. to about 450° C. for 1 to 4 hours.

In the cold roll process step, the HB is cold rolled to final-gauge bottle stock in H19 temper. The percentage reduction in the cold rolling step is about 65% to about 95%. The final gauge can be adjusted depending on bottle design. In one embodiment the final gauge range is 0.2 mm-0.8 mm.

In another embodiment, alloys described herein are produced by DC casting, homogenization, hot rolling, optional batch annealing, cold rolling, flash annealing and finish cold rolling.

In the homogenization step, the ingot is heated at a rate of about 20° C. to about 80° C./hour to less than about 630° C. (preferably to within a range of about 500° C. to about 630° C.) and soaked for 1-6 hours, optionally including the step of being cooling down to within a range of about 400° C. to about 550° C. and soaked for 8-18 hours.

In the hot rolling step, the homogenized ingot is laid down within a temperature range of about 400° C. to about 580° C., break-down rolled, hot rolled to a gauge range of about 1.5 mm to about 3 mm and coiled within a temperature range of about 250° C. to about 380° C.

In the optional batch annealing, the HB coil is heated to within a range of about 250° C. to about 450° C. for 1-4 hours.

In the cold roll process step, the HB is cold rolled to an inter-annealing gauge about 10-40% thicker than final bottle stock.

In the flash annealing step (H191 temper), the cold rolled sheet is heated to within a range of about 400° C. to about 560° C. at a heating rate of about 100° C./second to about 300° C./second for up to about 10 minutes and then quenched down to a temperature below 100° C. at a rapid cooling rate of about 100° C./second to about 300° C./second either by air quench or water/solution quench. This step enables dissolving most of the solution elements back into the matrix and further controls grain structure.

In the finish cold rolling step, the annealed sheet is cold rolled to achieve a 10-40% reduction to final gauge within a short time range (preferably less than about 30 min, about 10 to about 30 min, or less than about 10 min). This step has multiple effects: 1) annihilating vacancies, suppressing elemental diffusion and thus stabilizing alloys and minimizing or retarding natural ageing; 2) generating a high density of dislocations in the sheet which will promote elementary diffusion in the bottle forming process; and, 3) work-hardening the sheet. Items 1 and 2 will secure formability in bottle forming and final bottle strength. Items 2 and 3 will contribute to secure the dome reversal pressure.

The sheet products for bottle/can application may be delivered in H191+ finish cold roll status.

The bottles are produced with a bottle forming process consisting of blanking, cupping, drawing and ironing (D&I), wash and dry, coating/decoration and curing, forming, further shaping (necking, threading and curling).

Alloys described herein can be used to make highly shaped bottles, cans, electronic devices such as battery cans, cases and frames, etc.

Other objects and advantages of the invention will be apparent from the following summary and detailed description of the embodiments of the invention taken with the accompanying drawing figures.

DESCRIPTION OF THE INVENTION

Definitions and Descriptions

Figure 1:
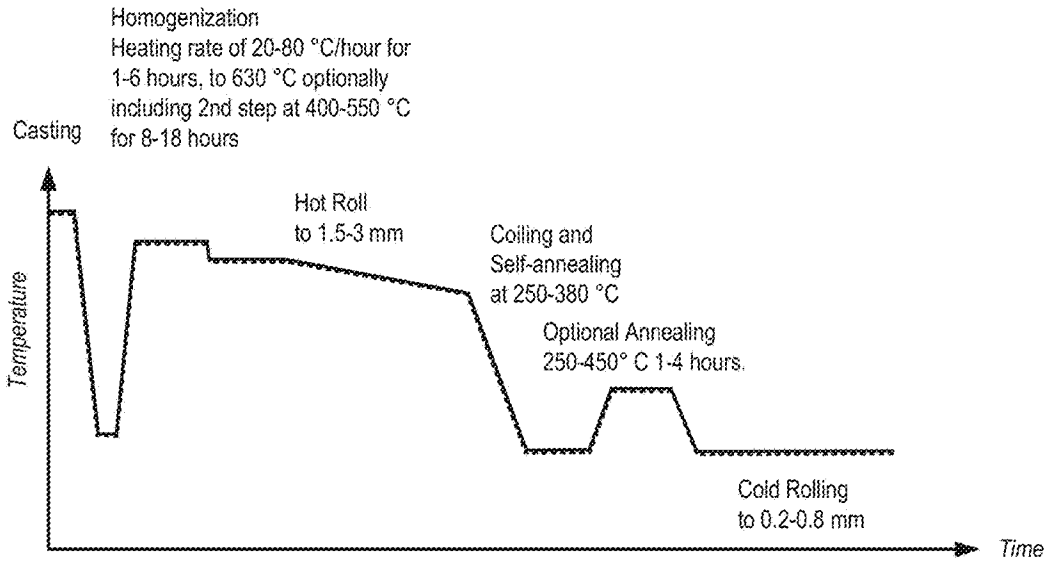
FIG. 1 is a schematic representation of thermomechanical processing of alloys described herein.

The terms "invention," "the invention," "this invention" and "the present invention" used herein are intended to refer broadly to all of the subject matter of this patent application and the claims below. Statements containing these terms should be understood not to limit the subject matter described herein or to limit the meaning or scope of the patent claims below.

As used herein, the meaning of "a," "an," or "the" includes singular and plural references unless the context clearly dictates otherwise.

Reference is made in this application to alloy temper or condition. For an understanding of the alloy temper descriptions most commonly used, see "American National Standards (ANSI) H35 on Alloy and Temper Designation Systems."

The following aluminum alloys are described in terms of their elemental composition in weight percentage (wt. %) based on the total weight of the alloy. In certain embodiments of each alloy, the remainder is aluminum, with a maximum wt. % of 0.15% for the sum of the impurities.

In one embodiment the invention is related to new formable and strong aluminum alloys for making highly shaped packaging products such as bottles and cans. In the forming and further shaping processes, the metal displays good combination of formability and strength. In one embodiment, the invention provides chemistry and manufacturing processes that are optimized for production of those products. The alloys described herein have the following specific chemical composition and properties.

Alloys

In certain embodiments, the disclosed alloys include manganese (Mn) in an amount from 0.1% to 1.6% (e.g., from 0.8% to 1.6%, 0.9% to 1.6%, 0.95% to 1.6%, 0.1% to 1.5%, 0.8% to 1.5%, 0.9% to 1.5%, 0.95% to 1.5%, 0.1% to 1.4%, 0.8% to 1.4%, 0.9% to 1.4%, 0.95% to 1.4%, 0.1% to 1.3%, 0.8% to 1.3%, 0.9% to 1.3%, 0.95% to 1.3%). For example, the alloys can include 0.1%, 0.2%, 0.3%, 0.4%, 0.5%, 0.6%, 0.7%, 0.8%, 0.9%, 0.95%, 1.0%, 1.1%, 1.2%, 1.3%, 1.4%, 1.5%, or 1.6% Mn. All expressed in wt. %.

In certain embodiments, the disclosed alloys include magnesium (Mg) in an amount from 0.1% to 3% (e.g., from 0.2% to 3.0%, 0.25% to 3.0%, 0.3% to 3.0%, 0.5% to 3.0%, 0.6% to 3.0%, 0.65% to 3.0%, 0.7% to 3.0%, 0.1% to 1.5%, 0.2% to 1.5%, 0.25% to 1.5%, 0.3% to 1.5%, 0.5% to 1.5%, 0.6% to 1.5%, 0.65% to 1.5%, 0.7% to 1.5%, 0.1% to 1.3%, 0.2% to 1.3%, 0.25% to 1.3%, 0.3% to 1.3%, 0.5% to 1.3%, 0.6% to 1.3%, 0.65% to 1.3%, 0.7% to 1.3%, 0.1% to 1.2%, 0.2% to 1.2%, 0.25% to 1.2%, 0.3% to 1.2%, 0.5% to 1.2%, 0.6% to 1.2%, 0.65% to 1.2%, 0.7% to 1.2%, 0.1% to 1.1%, 0.2% to 1.1%, 0.25% to 1.1%, 0.3% to 1.1%, 0.5% to 1.1%, 0.6% to 1.1%, 0.65% to 1.1%, 0.7% to 1.1%, 0.1% to 1.0%, 0.2% to 1.0%, 0.25% to 1.0%, 0.3% to 1.0%, 0.5% to 1.0%, 0.6% to 1.0%, 0.65% to 1.0%, 0.7% to 1.0%, 0.1% to 0.9%, 0.2% to 0.9%, 0.25% to 0.9%, 0.3% to 0.9%, 0.5% to 0.9%, 0.6% to 0.9%, 0.65% to 0.9%, 0.7% to 0.9%, 0.1% to 0.85%, 0.2% to 0.85%, 0.25% to 0.85%, 0.3% to 0.85%, 0.5% to 0.85%, 0.6% to 0.85%, 0.65% to 0.85%, 0.7% to 0.85%, 0.1% to 0.8%, 0.2% to 0.8%, 0.25% to 0.8%, 0.3% to 0.8%, 0.5% to 0.8%, 0.6% to 0.8%, 0.65% to 0.8%, 0.7% to 0.8%, 0.1% to 0.6%, 0.2% to 0.6%, 0.25% to 0.6%, 0.3% to 0.6%, 0.5% to 0.6%, 0.6% to 0.6%, 0.65% to 0.6%, 0.7% to 0.6%). For example, the alloys can include 0.1%, 0.2%, 0.25%, 0.3%, 0.4%, 0.5%, 0.6%, 0.65%, 0.7%, 0.8%, 0.85% 0.9%, 0.95%, 1.0%, 1.1%, 1.2%, 1.3%, 1.4%, 1.5%, 1.6%, 1.7%, 1.8%, 1.9%, 2.0%, 2.1%, 2.2%, 2.3%, 2.4%, 2.5%, 2.6%, 2.7%, 2.8%, 2.9%, or 3.0% Mg. All expressed in wt. %.

In certain embodiments, the disclosed alloys include copper (Cu) in an amount from 0.1% to 1.5% (e.g., from 0.3% to 1.5%, 0.35% to 1.5%, 0.4% to 1.5%, 0.45% to 1.5%, 0.5% to 1.5%, 0.1% to 1.0%, 0.3% to 1.0%, 0.35% to 1.0%, 0.4% to 1.0%, 0.45% to 1.0%, 0.5% to 1.0%, 0.1% to 0.9%, 0.3% to 0.9%, 0.35% to 0.9%, 0.4% to 0.9%, 0.45% to 0.9%, 0.5% to 0.9%, 0.1% to 0.8%, 0.3% to 0.8%, 0.35% to 0.8%, 0.4% to 0.8%, 0.45% to 0.8%, 0.5% to 0.8%, 0.1% to 0.75%, 0.3% to 0.75%, 0.35% to 0.75%, 0.4% to 0.75%, 0.45% to 0.75%, 0.5% to 0.75%, 0.1% to 0.7%, 0.3% to 0.7%, 0.35% to 0.7%, 0.4% to 0.7%, 0.45% to 0.7%, 0.5% to 0.7%, 0.1% to 0.6%, 0.3% to 0.6%, 0.35% to 0.6%, 0.4% to 0.6%, 0.45% to 0.6%, 0.5% to 0.6%). For example, the alloys can include 0.1%, 0.2%, 0.3%, 0.35% 0.4%, 0.45%, 0.5%, 0.6%, 0.7%, 0.75%, 0.8%, 0.9%, 1.0%, 1.1%, 1.2%, 1.3%, 1.4%, of 1.5% Cu. All expressed in wt. %.

In certain embodiments, the disclosed alloys include iron (Fe) in an amount from 0.2% to 0.7% (e.g., from 0.3% to 0.7%, 0.35% to 0.7%, 0.4% to 0.7%, 0.2% to 0.6%, 0.3% to 0.6%, 0.35% to 0.6%, 0.4% to 0.6%, 0.2% to 0.55%, 0.3% to 0.55%, 0.35% to 0.55%, 0.4% to 0.55%, 0.2% to 0.5%, 0.3% to 0.5%, 0.35% to 0.5%, 0.4% to 0.5%). For example, the alloys can include 0.2%, 0.3%, 0.35% 0.4%, 0.5%, 0.55%, 0.6%, or 0.7% Fe. All expressed in wt. %.

In certain embodiments, the disclosed alloys include silicon (Si) in an amount from 0.1% to 0.6% (e.g., from 0.15% to 0.6%, 0.2%, to 0.6%, 0.25% to 0.6%, 0.1% to 0.5%, 0.15% to 0.5%, 0.2%, to 0.5%, 0.25% to 0.5%, 0.1% to 0.45%, 0.15% to 0.45%, 0.2%, to 0.45%, 0.25% to 0.45%, 0.1% to 0.4%, 0.15% to 0.4%, 0.2%, to 0.4%, 0.25% to 0.4%). For example, the alloys can include 0.1%, 0.15%, 0.2%, 0.25%, 0.3%, 0.4%, 0.45%, 0.5%, 0.55%, or 0.6% Si. All expressed in wt. %.

In certain embodiments, the disclosed alloys include chromium (Cr) in an amount from 0% to 0.3% (e.g., from 0.001% to 0.3%, 0% to 0.2%, 0.001% to 0.2%). For example, the alloys can include 0.001%, 0.01%, 0.1%, 0.2%, or 0.3% Cr. All expressed in wt %.

In certain embodiments, the disclosed alloys include zinc (Zn) in an amount from 0% to 0.6% (e.g., from 0 to 0.5%). For example, the alloys can include 0.001%, 0.01%, 0.1%, 0.2%, 0.3%, 0.4%, or 0.5% Zn.

In certain embodiments, the disclosed alloys include titanium (Ti) in an amount from 0% to 0.2% (e.g., from 0 to 0.1%). For example, the alloys can include 0.001%, 0.01%, 0.1%, or 0.2% Ti.

In one embodiment, the chemical composition of the alloy comprises 0.1-1.6 wt. % Mn, 0.1-3 wt. % Mg, 0.1-1.5 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

In another embodiment, the chemical composition of the alloy comprises 0.1-1.6 wt. % Mn, 0.5-3 wt. % Mg, 0.1-1.5 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

In still another embodiment, the chemical composition of the alloy comprises 0.8-1.5 wt. % Mn, 0.6-1.3 wt. % Mg, 0.4-1.0 wt. % Cu, 0.3-0.6 wt. % Fe, 0.15-0.5 wt. % Si, 0.001-0.2 wt. % Cr, 0-0.5 wt. % Zn, 0-0.1 wt. % Ti, <0.05 wt. % for each trace element, <0.15 wt. % for total trace elements and remainder Al.

In yet another embodiment, the chemical composition of the alloy comprises 0.9-1.4 wt. % Mn, 0.65-1.2 wt. % Mg, 0.45-0.9 wt. % Cu, 0.35-0.55 wt. % Fe, 0.2-0.45 wt. % Si, 0.001-0.2 wt. % Cr, 0-0.5 wt. % Zn, 0-0.1 wt. % Ti, <0.05 wt. % for each trace element, <0.15 wt. % for total trace elements and remainder Al.

In another embodiment, the chemical composition of the alloy comprises 0.95-1.3 wt. % Mn, 0.7-1.1 wt. % Mg, 0.5-0.8 wt. % Cu, 0.4-0.5 wt. % Fe, 0.25-0.4 wt. % Si, 0.001-0.2 wt. % Cr, 0-0.5 wt. % Zn, 0-0.1 wt. % Ti, <0.05 wt. % for each trace element, <0.15 wt. % for total trace elements and remainder Al.

In one embodiment, the chemical composition of the alloy comprises 0.1-1.6 wt. % Mn, 0.1-1.0 wt. % Mg, 0.1-1 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

In another embodiment, the chemical composition of the alloy comprises 0.8-1.5 wt. % Mn, 0.2-0.9 wt. % Mg, 0.3-0.8 wt. % Cu, 0.3-0.6 wt. % Fe, 0.15-0.5 wt. % Si, 0.001-0.2 wt. % Cr, 0-0.5 wt. % Zn, 0-0.1 wt. % Ti, <0.05 wt. % for each trace element, <0.15 wt. % for total trace elements and remainder Al.

In yet another embodiment, the chemical composition of the alloy comprises 0.9-1.4 wt. % Mn, 0.25-0.85 wt. % Mg, 0.35-0.75 wt. % Cu, 0.35-0.55 wt. % Fe, 0.2-0.45 wt. % Si, 0.001-0.2 wt. % Cr, 0-0.5 wt. % Zn, 0-0.1 wt. % Ti, <0.05 wt. % for each trace element, <0.15 wt. % for total trace elements and remainder Al.

In another embodiment, the chemical composition of the alloy comprises 0.95-1.3 wt. % Mn, 0.3-0.8 wt. % Mg, 0.4-0.7 wt. % Cu, 0.4-0.5 wt. % Fe, 0.25-0.4 wt. % Si, 0.001-0.2 wt. % Cr, 0-0.5 wt. % Zn, 0-0.1 wt. % Ti, <0.05 wt. % for each trace element, <0.15 wt. % for total trace elements and remainder Al.

In another embodiment, the chemical composition of the alloy comprises 0.1-1.6 wt. % Mn, 0.1-1.5 wt. % Mg, 0.1-1.5 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

In another embodiment, the chemical composition of the alloy comprises 0.1-1.6 wt. % Mn, 0.1-1.0 wt. % Mg, 0.1-1.0 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

In another embodiment, the chemical composition of the alloy comprises 0.1-1.6 wt. % Mn, 0.1-0.8 wt. % Mg, 0.1-0.8 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

In another embodiment, the chemical composition of the alloy comprises 0.1-1.6 wt. % Mn, 0.1-0.6 wt. % Mg, 0.1-0.6 wt. % Cu, 0.2-0.7 wt. % Fe, 0.10-0.6 wt. % Si, up to 0.3 wt. % Cr, up to 0.6 wt. % Zn, up to 0.2 wt. % Ti, <0.05 wt. % for each trace element, <0.15 wt. % for total trace elements and remainder Al.

Method of Producing the Alloys

The alloys described herein may be produced by a thermomechanical process including DC casting, homogenization, hot rolling, optional batch annealing, and cold rolling. In some embodiments, the process may further include flash annealing and finish cold rolling.

In the DC casting step, a certain casting speed is applied to control the formation of primary intermetallic particles in terms of size and density. The preferred range of casting speed is from 50-300 mm/min (e.g. 50-200 mm/min, 50-250 mm/min, 100-300 mm/min, 100-250 mm/min, 100-200 mm/min, 150-300 mm/min, 150-250 mm/min, 150-200, mm/min). This step yields an optimum particle structure in the final sheet that minimizes the tendency of metal failure facilitated by coarse intermetallic particles.

In the homogenization step, the ingot is heated to a temperature of no more than 650° C. (e.g. no more than 630° C.). The ingot is heated at a rate from 20° C./hour to 80° C./hour (e.g. 30° C./hour to 80° C./hour, 40° C./hour to 80° C./hour, 20° C./hour to 60° C./hour, 30° C./hour to 60° C./hour, 40° C./hour to 60° C./hour). The ingot is preferably heated to a temperature from 500° C. to about 650° C. (e.g. from about 550° C. to about 650° C., from about 550° C. to about 630° C., or from about 500 to 630° C.) and soaked for 1-6 hours (e.g. 1 hr, 2 hr, 3 hr, 4 hr, 5 hr, or 6 hr). The homogenization step optionally includes the step of cooling the ingot to a temperature from about 400° C. to about 550° C. (e.g. from about 450° C. to about 550° C., from about 450° C. to about 500° C., or from about 400° C. to about 500° C.) and soaking for 8-18 hours (e.g. 1 hr, 2 hr, 3 hr, 4 hr, 5 hr, 6 hr, 7 hr, 8 hr, 9 hr, 10 hr, 11 hr, 12 hr, 13 hr, 14 hr, 15 hr, 15 hr, 16 hr, 17 hr, or 18 hr). While not wanting to be bound by the following statement, it is believed that this step enables the sufficient transformation of α-Al(Fe, Mn)Si particles from Al6(Fe, Mn) particles and optimizes their size and density which are critical for texture control of final sheet and for die cleaning during D&I. It is also believed that this step enables the formation of homogeneously distributed dispersoids with optimized size and density distribution which are critical in controlling grain size and texture of the final sheet and in improving ductility of the metal during the bottle forming process.

In the hot rolling step, the homogenized ingot is laid down within a temperature range of from about 400° C. to 580° C. (e.g. from about 450° C. to about 580° C., from about 450° C. to about 500° C., from about 400° C. to about 500° C.), break-down rolled, hot rolled to a gauge range of about 1.5 mm to about 3 mm (e.g. 1.5 mm, 2.0 mm, 2.5 mm, 3.0 mm) and rerolled within a temperature range from about 250° C. to about 380° C. (e.g. from about 300° C. to about 380° C., from 320° C. to about 360° C.), followed by optional batch annealing in which the HB coil is heated to about 250° C. to about 450° C. for 1-4 hours. While not wanting to be bound by theory, it is believed that this step enables the optimum texture, grain size and near-surface-microstructure in the HBs which are critical to earing control in the D&I process and fracture control in the pressure ram forming (PRF) process. Break-down rolled means that about 15 to 25 passes occur in a break down mill with an entry temperature>350° C. and an exit temperature of from about 250° C. to about 400° C. (e.g., 250° C., 300° C., 350° C., 400° C.).

In one embodiment, in the cold roll process step, the HB is cold rolled to final-gauge bottle stock in H19 temper. In one embodiment the final gauge range is 0.2 mm to 0.8 mm (e.g., 0.2 mm, 0.3 mm, 0.4 mm, 0.5 mm, 0.6 mm, 0.7 mm, 0.8 mm).

In another embodiment, in the cold roll process step, the HB is cold rolled to an inter-annealing gauge. Then an optional inter-annealing may be applied to adjust the grain size, texture and strength. In a flash annealing step (H191 temper), the cold rolled sheet is heated to from about 400° C. to about 560° C. (e.g., 400° C. to 500° C., 450° C. to 500° C., 450° C. to 560° C.) at a rapid heating rate, for example from about 100° C./second to about 300° C./second (e.g., 100° C./second, 150° C./second, 200° C./second, 250° C./second, 300° C./second), for up to about 10 minutes (e.g., 1 min, 2 min, 3 min, 4 min, 5 min, 6 min, 7 min, 8 min, 9 min, 10 min) and then quenched down at a rapid cooling rate, for example from about 100° C./second to about 300° C./second (e.g., 100° C./second, 150° C./second, 200° C./second, 250° C./second, 300° C./second) for 0 to 1 second (e.g., 0 second, 0.5 second, 1 second). The quenching may be either air quenching or water/solution quenching. This step enables dissolving most of the solution elements back into the matrix and further controls grain structure.

After flash annealing, in a finish cold rolling step, the flash annealed sheet is cold rolled for 10% to 50% (e.g., 10% to 40%, 25% to 50%, 25% to 40%, 10%, 15%, 20%, 25%, 30%, 35%, 40%, 45%, or 50%) reduction to final gauge within a short time range (preferably less than about 30 minutes, 10 min to 30 min, or less than about 10 min). This step has multiple effects: 1) stabilizing alloying elements and preventing/retarding natural ageing; 2) generating a high density of dislocations in the sheet which will promote elementary diffusion in the bottle forming process; 3) work hardening the sheet. Items 1 and 2 will enhance formability in bottle forming and the final bottle strength. Items 2 and 3 contribute to the dome reversal pressure.

EXAMPLE 1

In one embodiment, alloys described herein are produced with a thermomechanical process including DC casting, homogenization, hot rolling, optional batch annealing, and cold rolling. A schematic representation of this process is shown in FIG. 1.

In the homogenization step, the ingot is heated at a rate of about 20° C. to about 80° C./hour to less than about 630° C. (preferably to within a range of about 500° C. to about 630° C.) and soaked for 1-6 hours, optionally including the step of being cooling down to within a range of about 400° C. to about 550° C. and soaked for 8-18 hours.

In the hot rolling step, the homogenized ingot is laid down within a temperature range of about 400° C. to about 580° C., break-down rolled, hot rolled to a gauge range of about 1.5 mm to about 3 mm and coiled within a temperature range of about 250° C. to about 380° C. for self-annealing.

In the optional batch annealing, the HB coil is heated to within a range of about 250° C. to about 450° C. for 1 to 4 hours.

In the cold roll process step, the HB is cold rolled to final-gauge bottle stock in H19 temper. The percentage reduction in the cold rolling step is about 65% to about 95% (e.g., 70% to 90%, 75% to 85%). The final gauge can be adjusted depending on bottle design. In one embodiment the final gauge range is from 0.2 mm to 0.8 mm.

The bottles are produced with a bottle forming process consisting of blanking, cupping, D&I, wash and dry, coating/decoration and curing, forming, further shaping (necking, threading and curling).

EXAMPLE 2

Figure 2:
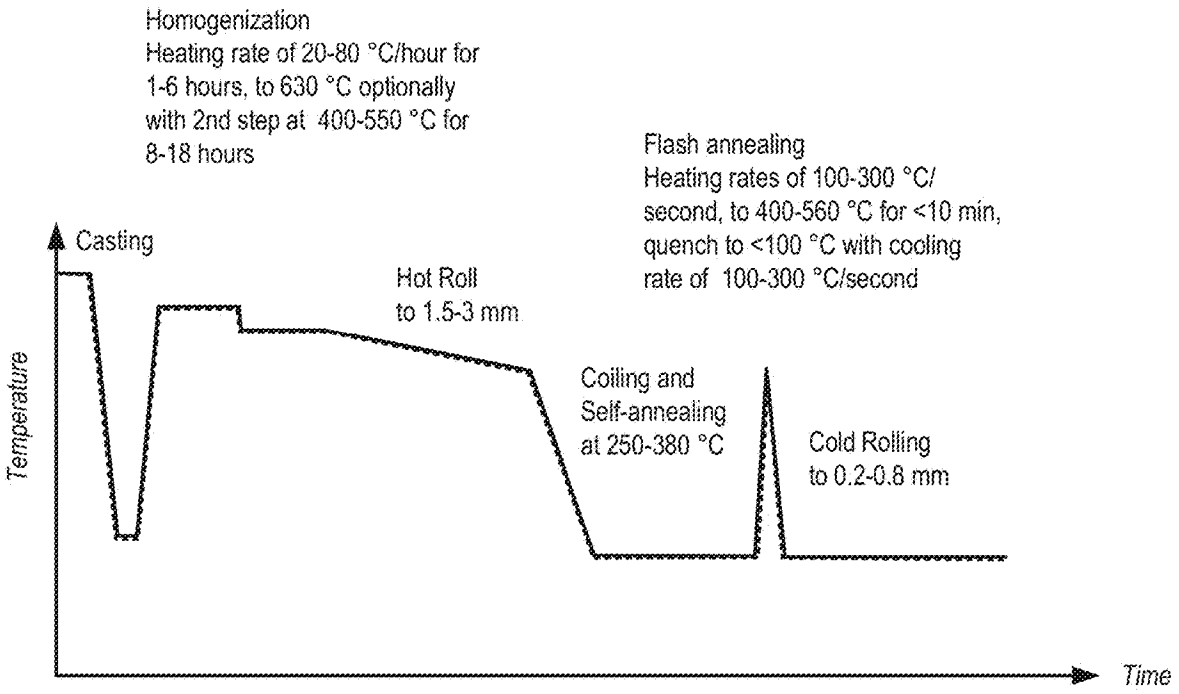
FIG. 2 is a schematic representation of a process for forming bottles and cans using alloys described herein.

In another embodiment, alloys described herein are produced by DC casting, homogenization, hot rolling, optional batch annealing, cold rolling, flash annealing and finish cold rolling. A schematic representation of this process is shown in FIG. 2.

The DC casting, homogenization, hot rolling, and optional batch annealing are described in Example 1.

In the cold roll process step, the HB is cold rolled to an inter-annealing gauge about 10-40% thicker than final bottle stock.

In the flash annealing step (H191 temper), the cold rolled sheet is heated to within a range of about 400° C. to about 560° C. at a heating rate of about 100° C./second to about 300° C./second for up to about 10 minutes and then quenched down to a temperature below 100° C. at a rapid cooling rate, for example of about 100° C. to about 300° C./second, either by air quench or water/solution quench. This step enables dissolving most of the solution elements back into the matrix and further controls grain structure.

In the finish cold rolling step, the annealed sheet is cold rolled to achieve a 10-40% reduction to final gauge within a short time range (preferably less than about 30 minutes, 10 min to 30 min, or less than about 10 min). This step has multiple effects: 1) annihilating vacancies, suppressing elemental diffusion and thus stabilizing alloys and minimizing or retarding natural ageing; 2) generating a high density of dislocations in the sheet which will promote elementary diffusion in the bottle forming process; and, 3) work-hardening the sheet. Items 1 and 2 will secure formability in bottle forming and final bottle strength. Items 2 and 3 will contribute to secure the dome reversal pressure.

Sheet products for bottle/can application may be delivered in H191+ finish cold roll status.

Bottles may be produced with a bottle forming process as described herein and consisting of blanking, cupping, D&I, wash and dry, coating/decoration and curing, forming, further shaping (necking, threading and curling).

Figure 3:
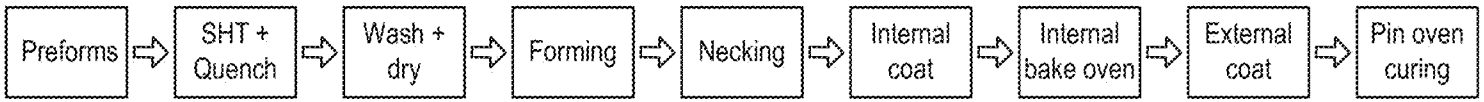
FIG. 3 is a schematic representation of thermomechanical processing of alloys described herein.
Figure 4:
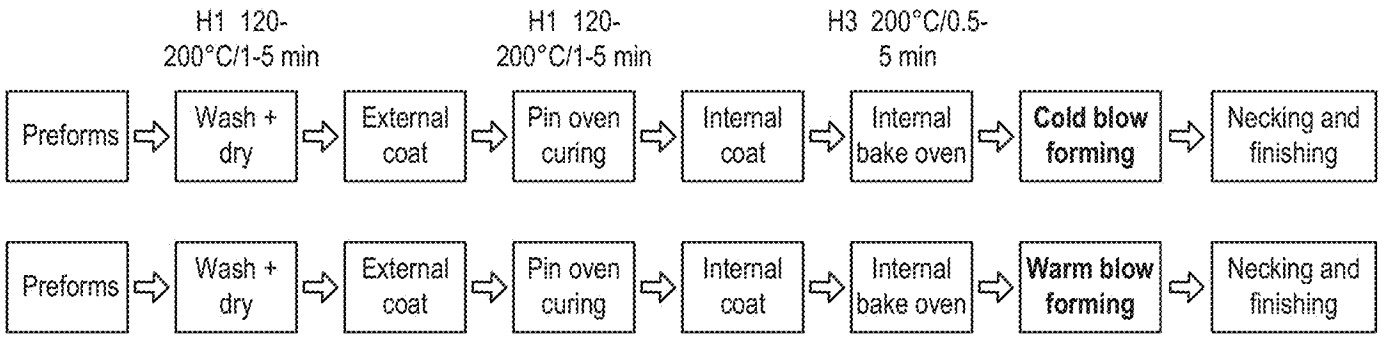
FIG. 4 Is a schematic representation of two processes for forming bottles and cans using alloys described herein. H1, H2, H3 indicate heating steps occurring in the boxes immediately below in this figure.

Bottle Forming:

Alloys described herein can be used to make highly shaped bottles, cans, electronic devices such as battery cans, cases and frames, etc. Schematic representations of processes for forming shaped bottles using alloys described herein are shown in FIGS. 3-4.

The preforms are produced with a process consisting of blanking, cupping, D&I. Then the preforms are heat treated at a certain solution heat treatment (SHT) temperature of about 400° C. to about 560° C. (e.g. 400° C.-500° C., 450-500° C., 450° C.-560° C.), quenched and washed (note that quenching and washing may be in a combined process), PRF or blow formed, further shaped (necking, threading and curling) and subsequently painted or decorated during which paint baking/curing at an elevated temperature up to about 300° C. is applied for up to about 20 minutes.

In the preform forming process, alloys described herein display good die cleaning and earing level during the D&I process. Those properties are likely due to well controlled constituent particles with optimum size and density and texture in bottle/can stock.

In the PRF step or the blow forming step, the annealed preforms are blow formed within a certain time frame preferably less than 1 hour (more preferably less than 10 min) after quenching.

In the shaping step, the blow formed bottles are necked, threaded and curled within a certain time frame preferably less than 2 hours (more preferably less than 30 min) after quenching.

During the blow forming and shaping process, the metal displays good formability because of the solution heat treatment (preform annealing).

In the wash/dry and paint/decoration curing steps, the metal will be concurrently precipitation hardened by a second phase precipitation, such as S"/S', θ"/θ' and or β"/β' phase(s). Together with cold work inherited from finishing cold work, the second phase precipitation ensures the finished bottle meets strength requirements, such as dome reversal pressure and axial load. Depending on alloying level, bottle shape design and strength requirements on bottles, although unlikely, an optional preheating (pre-ageing) process may be incorporated prior to the paint/decoration curing step.

The aluminum alloys described herein display one or more of the following properties:

- Very low earing (max. mean earing level of 3 wt. %), the earing balance is between −2% and 2%). The mean earing is calculated by the equation Mean Earing (%)=(peak height−valley height)/cup height. The earing balance is calculated by the equation Earing balance (%)=(mean of two 0/180 heights−mean of four 45 degree heights)/cup height;
- high recycled content (at least 60 wt. %, 65 wt. %, 70 wt. %, 75 wt. %, 80 wt. %, 82 wt. %, 85 wt. %, 90 wt. %, or 95 wt. %);
- yield strength 20-34 ksi in supply condition;
- excellent die cleaning performance which allows for scoring to be minimized and have better runnability;
- excellent formability which allows extensive neck shaping progression without fracture;
- excellent formability which allows extensive blow forming shaping progression without fracture;
- excellent surface finished in the final bottles with no visible markings;
- excellent coating adhesion;
- high strength to meet the typical axial load (>300 lbs) and dome reversal pressure (>90 psi);
- overall scrap rate of the bottle making process can be as low as less than 10 wt. %

The shaped aluminum bottle described herein may be used for beverages including but not limited to soft drinks, water, beer, energy drinks and other beverages.

It is to be clearly understood that resort may be had to various embodiments, modifications and equivalents thereof which, after reading the description herein, may suggest themselves to those skilled in the art without departing from the spirit of the invention. All patents, publications and abstracts cited above are incorporated herein by reference in their entirety. It should be understood that the foregoing and the figures relate only to preferred embodiments of the present invention and that numerous modifications or alterations may be made therein without departing from the spirit and the scope of the present invention as defined in the following claims.

The invention claimed is:

1. An aluminum alloy comprising:
0.1-1.6 wt. % Mn,
0.1-0.6 wt. % Mg,
0.45-1.0 wt. % Cu,
0.2-0.7 wt. % Fe,
0.10-0.6 wt. % Si,
up to 0.3 wt. % Cr,
up to 0.6 wt. % Zn,
up to 0.2 wt. % Ti,
<0.05 wt. % for each trace element,
<0.15 wt. % for total trace elements and remainder Al.

2. The alloy of claim 1 comprising:
0.8-1.5 wt. % Mn,
0.3-0.6 wt. % Fe,
0.15-0.5 wt. % Si,
0.001-0.2 wt. % Cr,
0-0.5 wt. % Zn, and
0-0.1 wt. % Ti.

3. The alloy of claim 2 comprising:
0.9-1.4 wt. % Mn,
0.45-0.9 wt. % Cu,
0.35-0.55 wt. % Fe, and
0.2-0.45 wt. % Si.

4. The alloy of claim 3 comprising:
0.95-1.3 wt. % Mn,
0.5-0.8 wt. % Cu,
0.4-0.5 wt. % Fe, and
0.25-0.4 wt. % Si.

5. The alloy of claim 1 comprising:
0.8-1.5 wt. % Mn,
0.3-0.6 wt. % Fe,
0.15-0.5 wt. % Si,
0.001-0.2 wt. % Cr,
0-0.5 wt. % Zn, and
0-0.1 wt. % Ti.

6. The alloy of claim 5 comprising:
0.9-1.4 wt. % Mn,
0.35-0.55 wt. % Fe, and
0.2-0.45 wt. % Si.

7. The alloy of claim 6 comprising:
0.95-1.3 wt. % Mn,
0.4-0.5 wt. % Fe,
0.25-0.4 wt. % Si, and
0.001-0.2 wt. % Cr.

8. The aluminum alloy of claim 1, comprising a recycle content of at least 60 wt. %.

9. The aluminum alloy of claim 8, comprising a recycle content of at least 85 wt. %.

10. A shaped aluminum bottle comprising the aluminum alloy of claim 1.

* * * * *